United States Patent [19]

Todd Jr.

[11] Patent Number: 4,567,350

[45] Date of Patent: Jan. 28, 1986

[54] COMPACT HIGH FLOW RATE ELECTRIC INSTANTANEOUS WATER HEATER

[76] Inventor: Alvin E. Todd Jr., P. O. Box 924 Vickwood Hills, Pigeon Forge, Tenn. 37863

[21] Appl. No.: 456,327

[22] Filed: Jan. 6, 1983

[51] Int. Cl.[4] ..... H05B 1/02; H05B 3/82; F24H 1/10

[52] U.S. Cl. ..... 219/298; 219/213; 219/306; 219/308; 219/309; 219/321; 219/328

[58] Field of Search ..... 219/296–309, 219/320, 321, 213, 327, 328

[56] References Cited

U.S. PATENT DOCUMENTS

| | | | |
|---|---|---|---|
| 2,055,500 | 9/1936 | McLeod | 219/213 |
| 2,843,717 | 7/1958 | Tracy | 219/303 X |

FOREIGN PATENT DOCUMENTS

| | | | |
|---|---|---|---|
| 157948 | 7/1954 | Australia | 219/297 |
| 209116 | 6/1957 | Australia | 219/306 |
| 2355988 | 5/1975 | Fed. Rep. of Germany | 219/309 |
| 609805 | 10/1960 | Italy | 219/306 |
| 527511 | 10/1940 | United Kingdom | 219/309 |
| 944881 | 12/1963 | United Kingdom | 219/310 |
| 1235849 | 6/1971 | United Kingdom | 219/296 |

OTHER PUBLICATIONS

Evan Powell, "Tankless Water Heaters—New Way To Lower Your Energy Bill," *Popular Science,* Feb. 1982, pp. 39–47.

Heatstream Brochure, Heatstream Corp., P.O. Box 1229, Conyers, Georgia 30207 (4 pages).

Thermar Literature (Thermar Instant, Tankless Heaters), Tankless Heater Corp., Melrose Square, Greenwich, Connecticut 06830. (20 pages).

Minitherm Brochure, International Technology Sales Co., 7344–G South Alton Way, Englewood, Colorado 80112, (6 pages).

*Primary Examiner*—A. Bartis

*Attorney, Agent, or Firm*—Leydig, Voit & Mayer

[57] ABSTRACT

A compact instantaneous-type electric water heater for household and commercial use provides hot water at a rate of at least five gallons per minute and includes a plurality of individual heating chambers connected in series flow relationship between a cold water inlet and a hot water outlet. A metallic mixing coil is disposed in series between each adjacent pair of chambers to promote even heating. The chambers are provided with electric heating elements having a combined wattage of at least thirty-thousand (30,000) watts. The heating elements are energized by a flow switch only at the time hot water is demanded and are controlled by an adjustable thermostat which sets the outlet water temperature and by a high temperature safety switch limiting outlet water temperature should the thermostat fail. The heating elements are connected to the electrical utility system by contactor-type relays so that some of the heating elements are connected to the service side of the utility system while the others are connected to the building side of the system. An adjustable regulator is provided to assure that the water flow rate will not exceed the capacity of the heater to heat the water to a minimum acceptable level. The heater is enclosed in a sheet metal casing capable of being accomodated inside a standard wood wall between a pair of adjacent studs thereof.

7 Claims, 7 Drawing Figures

COMPACT HIGH FLOW RATE ELECTRIC INSTANTANEOUS WATER HEATER

FIELD OF THE INVENTION

The present invention relates generally to the field of water heating apparatus, and, more particularly, to instanteous-type water heaters wherein water is heated immediately prior to the time it is used.

DESCRIPTION OF THE PRIOR ART

The conventional method of heating water for domestic use is to slowly heat water in a large holding tank having sufficient capacity to supply all of the hot water that a consumer would reasonably demand over a relatively long period of time. Representative dimensions of the tank are 21 inches in diameter and 66 inches in height. Not only does the standard water heater require a substantial amount of space, it also wastes energy since the water is kept hot at all times.

Since the conventional water heater is especially inefficient for intermittent use, instantaneous-type water heaters have been developed which heat the water immediately prior to its use. Typically known as "in line heaters", they supply hot water at a rather limited flow rate.

SUMMARY OF THE INVENTION

It is a principal object of the present invention to replace the conventional bulky storage-tank water heater with a compact, space saving unit which also provides an unlimited supply of hot water at a high flow rate in sufficient volume to service an entire house.

It is another object of the present invention to provide an instantaneous-type water heater which can supply heat energy at a rate of at least 30 kilowatts.

A further object of the invention is to provide an instantaneous-type water heater which has precise temperature regulation and insures that the water delivered is at an even temperature.

It is a further object to provide an instantaneous-type water heater which may be easily wired to accept either single or multiple sources of electrical power.

A further object of the invention is to provide an instantaneous-type water heater having means for regulating against excessive hot water demand, means for limiting the water temperature in the event of thermostat malfunction, and means for activating the water heater only when hot water is desired by the consumer.

Other objects and advantages of the invention will become apparent from the following detailed description and the accompanying drawings.

In accordance with the present invention, an instantaneous water heater provides hot water at a high flow rate and even temperature by passing the water to be heated through a series of water heating chambers and means between the heating chambers for mixing the water so that the water tends to be evenly heated. In order that the instantaneous water heater consumes power only when the consumer demands hot water, the instantaneous water heater has means responsive to the flow of water to turn on electrical heating elements in the heating chambers. The heating elements are also controlled by an adjustable thermostat which sets the final temperature of the hot water. A high temperature sensing switch is also used as a safety device to turn off the heating elements if a high temperature limit is exceeded. To further insure that the hot water is delivered at a desired temperature, the instantaneous water heater includes an adjustable means for limiting the rate of flow of water from the heater so that the heating elements can always raise the water temperature to an acceptable minimum temperature. But this maximum flow rate is indeed quite high since according to an important aspect of the invention the combined power dissipation of the heating elements is at least thirty-thousand (30,000) watts, thereby providing a flow rate of at least five gallons per minute. The instantaneous water heater, however, may be built into a generally rectangular sheet metal case approximately four inches deep and fourteen and one-half inches wide so that it may be mounted inside a standard wood wall between the studs, thereby saving space. The electrical connection between the utility system and the heating elements is provided by contactor-type relays so that the heating elements may be wired to the electrical utility system to accommodate various sourcing configurations, including dual sourcing wherein some of the heating elements are connected to the service side of the utility system, and the other heating elements are connected to the building side of the utility system.

Figure 1:
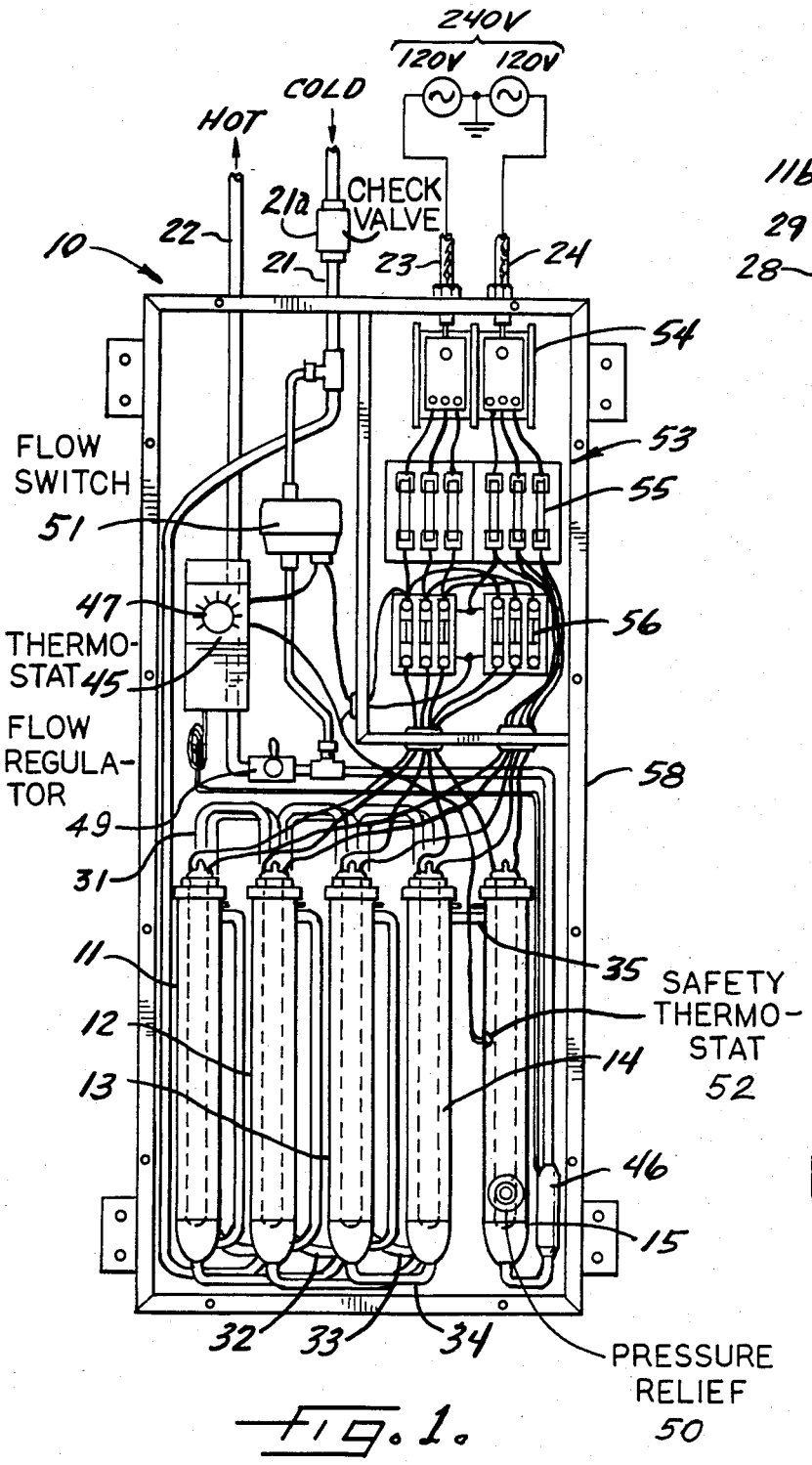
FIG. 1 is a front elevation of the instantaneous water heater according to the invention with the front cover of the sheet metal housing removed.

While the invention is susceptible to various modifications and alternative forms, a specific embodiment thereof has been shown by way of example in the drawings and will be described in detail herein. It should be understood, however, that it is not intended to limit the invention to the particular form disclosed, but, on the contrary, the intention is to cover all modifications, equivalents, and alternatives falling within the spirit and scope of the invention as defined by the appended claims.

DESCRIPTION OF THE PREFERRED EMBODIMENT

Figure 2:
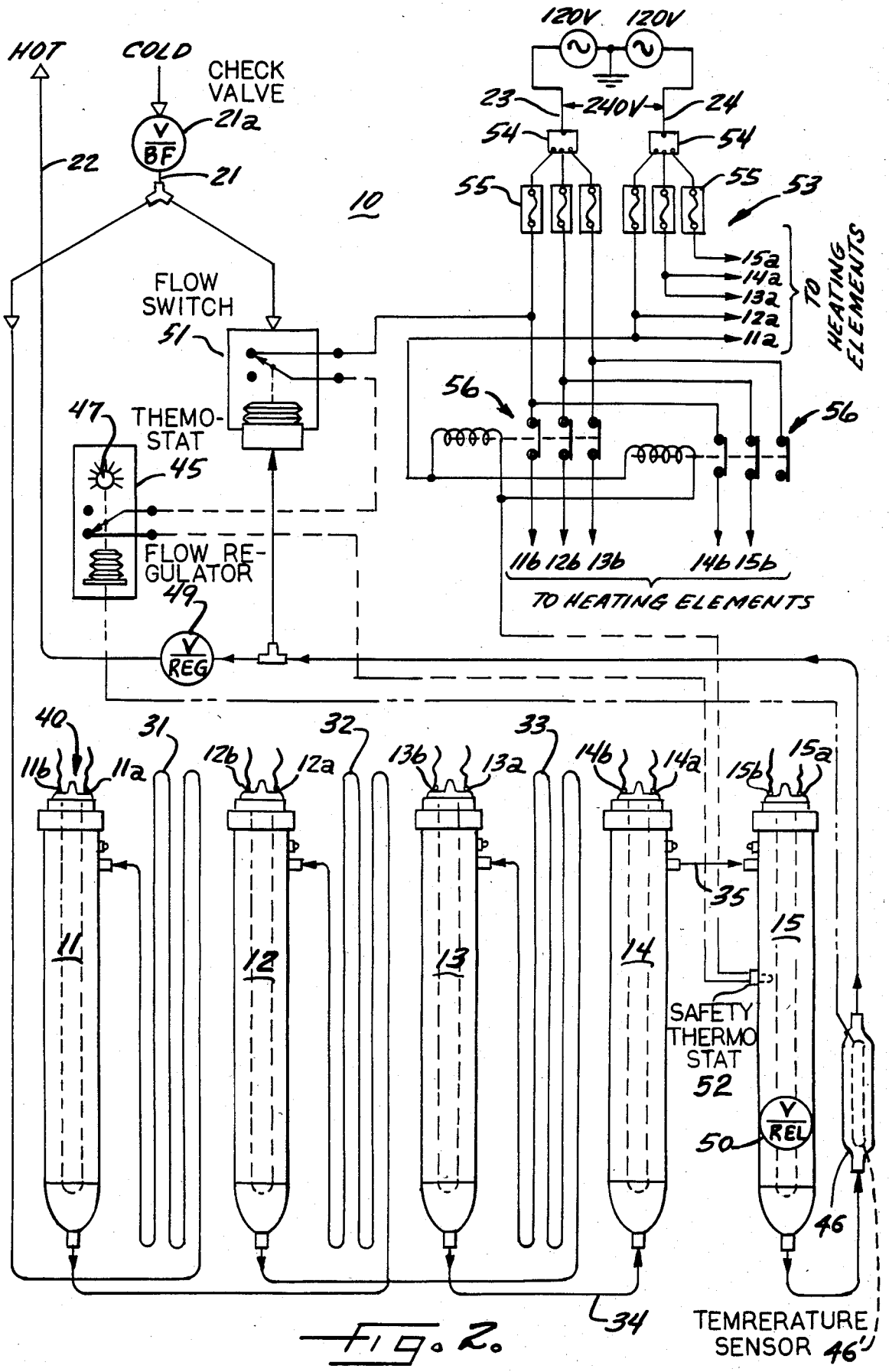
FIG. 2 is a schematic diagram showing the water, electrical, and signal flow in the instantaneous water heater drawn to correspond to the pictoral view in FIG. 1.

Turning now to the drawing and referring first to FIGS. 1 and 2, there is shown an instantaneous hot water heater generally designated 10 having a cold water input pipe 21, a hot water output pipe 22, and a pair of electrical lines 23, 24 supplying 240 volts from the service lines of the electrical utility system. Generally speaking, the instantaneous water heater 10 senses the flow of water in the cold water pipe 21 and out the hot water pipe 22, and when a substantial flow is present the water heater transfers electrical energy from the service lines 23, 24 to heat energy in the water flowing out the hot water pipe 22. In fact, the electrical power consumed at any given time is approximately that amount of power required to heat the quantity of water flowing out the hot water pipe 22.

The actual heating of the water takes place in five series-connected water heating chambers designated 11–15. As shown, the cold water flows into the cold water pipe 21 after passing through a back-flow prevention valve 21*a* (which might be required by some local utility codes). The cold water then passes through a copper mixing pipe 31 to the top of the first heating chamber 11. The water flows out the bottom of the heating chamber 11 through a second copper mixing pipe 32 to the top of the second heating chamber 12. Similarly, a third copper mixing pipe 33 interconnects the second and third heating chambers 12, 13. A short copper pipe 34 interconnects the bottoms of the third and fourth heating chambers 13 and 14. The top of the fourth heating chamber 14 is connected to the top of the last heating chamber 15 by a short length of copper pipe 35.

Figure 3:
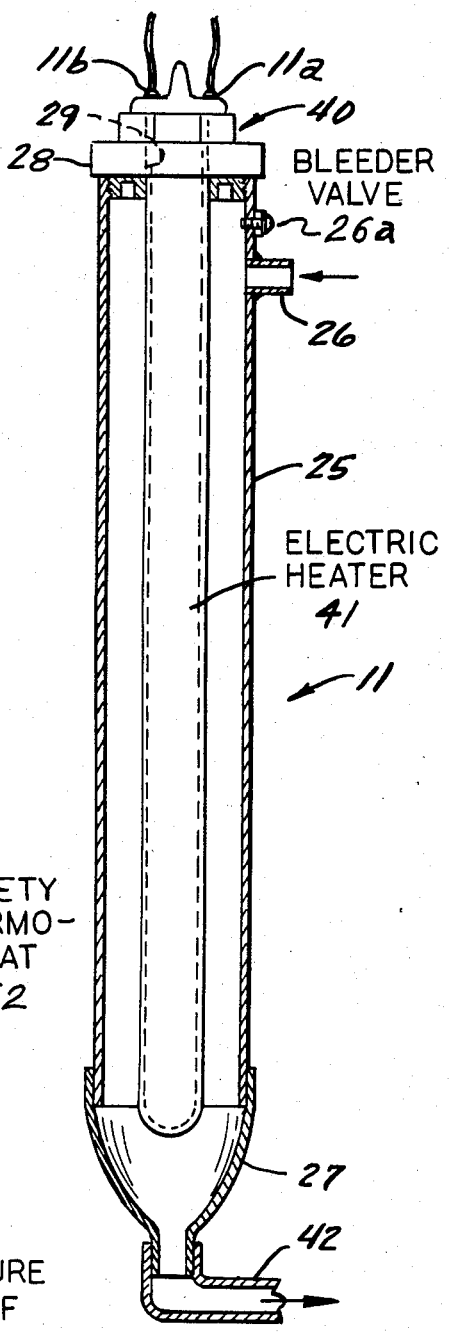
FIG. 3 is an enlarged view, partially in section, of one of the heating chambers used in the water heater.

The first heating chamber 11 is shown in greater detail in FIG. 3. The outer wall of the heating chamber is a cylindrical copper pipe 25 having an inlet pipe 26 brazed at its top end portion and having a funnel 27 brazed on its bottom end. Above the inlet pipe 26 is a bleeder valve 26*a* for permitting the release of air out of the heating chamber 11 when the instantaneous water heater 10 is installed. The bleeder valve 26*a* is merely a machine screw and sealing washer, the machine screw being received by a nut brazed over a hole in the cylindrical pipe 25. The top end of the cylindrical pipe 25 is screwed or otherwise attached to a collar 28 having a bore 29 receiving a heating element generally designated 40. The heating element 40 is known in the trade as a Calrod and in the embodiment shown each of the heating elements has a six kilowatt rating, or 25 amperes at 240 volts (APCOM Part No. D3025H). The heating element 40 has electrical leads 11*a*, 11*b* which internally connect to an electrical heater inside a tubular rod 41. Thus, water entering the inlet pipe 26 flows through the cylindrical pipe 25 and passes down and around the heated rod 41 to the bottom funnel 27 and exits from an elbow pipe 42.

The mixing coils 31–33 which precede and interconnect the first heating three chambers 11–13 perform a number of functions which promote even heating of the water. The mixing coils 31–33 serve as a temporary reservoir of water at room temperature so that the water delivered to the consumer when he first turns on his hot water faucet becomes heated to a hot temperature almost instantaneously. This is especially important during winter when the water flowing in the cold water input pipe 21 could be at a very low temperature, for example, about 40° F. By temporarily storing water at room temperature in the mixing coils 31–33, an approximately 30° F. temperature rise to room temperature is performed even before the consumer turns on his hot water tap. Short pipes 34, 35 rather than mixing coils are placed between the last three heating chambers 13–15. If mixing coils were used in lieu of these short pipes 34, 35, the water stored in these mixing coils would not be heated to the desired high temperature merely by passing through the last two heating chambers 14–15. In particularly severe cold weather environments, the mixing coils 31–33 could be kept at room temperature by wrapping them in electrically heated "heat tape".

A second function performed by the mixing coils 31–33, as well as the short pipes 34–35, is to interconnect the heating chambers 11–15 so that the flow of water is disrupted as it passes by one heating element 40 to the next so that the water is more evenly heated.

A third function performed by the metal mixing coils 31–33 is to temporarily store and exchange heat so that the water flowing out of each mixing coil is at a more uniform temperature than when it flowed into the mixing coil. In other words, a temporary surge of hot water flowing into a mixing coil tends to give up its heat to the metal walls of the pipe making up the coil so that the heat may later be absorbed by cooler water flowing through the coil.

In order to assure that the water is heated to a desired high temperature, a thermostat switch 45 is activated by the temperature of the water flowing out of the last heating chamber 15 as sensed by a temperature sensing bulb 46' inside an enlargement 46 of the pipe from the heating chamber 15. The thermostat 45 has a user-adjustable control 47 calibrated over a range of temperature, for example 60°–170° F. (Honeywell Part No. T675A). The precise temperature control provided is especially desirable when the instantaneous water heater is used in nursing homes. Children as well as the elderly are protected from scalding.

Under some conditions of extremely high flow rate, the thermostat 45 may be ineffective to regulate the desired water temperature if the combined heating capacity of the heating elements 40 is insufficient to raise the temperature of the cold water on the input pipe 21 to the desired temperature. For the embodiment shown, this is an unlikely event since the combined electrical dissipation of the heating elements 40 is thirty-thousand (30,000) watts, which is sufficient to heat at least five gallons of water per minute. But the possibility exists that more than one consumer will demand hot water at the same time which could exceed the five gallon per minute rate. If the flow rate is not limited, for example, two users could open their hot water taps expecting to receive more hot water, but instead they would receive more cool water. Under these circumstances it is usually better to receive a proportionate but smaller share of hot water than to receive a large share of cool water.

So that the instantaneous water heater will always deliver hot water, a flow regulating valve 49 is placed in the series water connection between the cold water input pipe 21 and the hot water output pipe 22 as a means for limiting the maximum flow of water from the input pipe to the output pipe. Preferably an adjustable valve such as a ⅜ inch "gate valve" is used so that the maximum flow may be limited to a rate at which the heating elements can raise the water temperature to an acceptable minimum hot temperature, depending on the user's desired minimum hot temperature and the local water pressure. If ⅜ inch diameter copper pipe is used for the coils 31–33 and the other pipes 21, 22, 34, 35, a flow rate of up to 5 gallons per minute may be obtained. This may be increased to 8 gallons per minute by using ½ inch diameter pipe, although in this case the total power dissipation of the heating elements should be 48,000 watts to heat the increased flow of water.

As a safety precaution (and as might be required by some local utility codes) a pressure relief valve 50 is connected to vent the last heating chamber 15 in case of an abnormal pressure build-up. Although a pressure relief valve could be connected at the hot water output pipe 22, it is safer to locate the pressure relief valve at the bottom of the last heating chamber 15 since the highest temperatures and pressures are generated there.

The heating elements 40 are further controlled so that they are turned off completely when the consumer does not require hot water. In a conventional tank-type water heater, the heating element may be on even though the consumer does not need hot water since the temperature of the water in the tank is always set at a hot temperature. Thus for the tank-type water heater there is always a heat loss through the walls of the tank to the outside environment, and this heat loss wastes energy. The energy loss ranges from about 17 to 21% for conventional electric water heaters. For motels, vacation homes and other locations that are infrequently occupied this heat loss is indeed excessive and for this reason the tank heater may be shut off when the premises are not occupied. Not only does this require intervention on the part of the consumer, but it may take considerable time for the water in the tank to reach a desired high temperature when the heater is turned back on.

In contrast to the tank-type water heater, the instantaneous water heater does not use electricity during idle periods and automatically turns itself on when hot water is desired by the consumer and turns itself off after the consumer's needs have been satisfied. Thus the instantaneous water heater is especially suited for locations that are temporarily occupied. In order to sense the actual consumer demand for hot water, means responsive to the flow of the water activates a flow switch which must be on in order for the heating elements 40 to receive power from the power lines 23, 24. Preferrably, the flow sensing means is active when the flow exceeds a predetermined threshold, so that a drip or slight leak of water from a hot water faucet does not activate the instantaneous water heater. For the embodiment shown in FIG. 1, the flow is sensed by a pressure-sensitive switch 51 shunting the water path through the heating chambers 11–15 and the series-connecting pipes 31–35. Since the heating chambers and interconnecting pipe present a resistance to the flow of water, a pressure proportional to the rate of flow is generated across the pressure-sensing switch 51. Note that the flow regulating valve 49 is not part of the flow resistance, so that the flow resistance is generally constant. The flow switch 51 is normally open and closes when a pressure is generated by a flow rate exceeding the desired threshold flow. A representative pressure-sensing switch is the Delaval EPDISAA3 (Barksdale Controls Div.).

For safety, the instantaneous water heater also has a normally-closed high temperature switch 52 for shutting off the heating elements 40 in the event that there is a malfunction of the thermostat 45. The high-temperature switch 52 has a factory-set threshold temperature which should be above the upper range of the thermostat control 47. The high-temperature switch 52 is placed in the last water heating chamber 15.

The electrical components for controlling the flow of power from the power lines 23, 24 to the heating elements 40 are enclosed in a separate section generally designated 53 in the upper right-hand corner of the instantaneous water heater 10. The power lines 23, 24 are anchored at a contact block 54 which splits each main line 23, 24 into three separate lines leading to individual 60 amp fuses 55. For the embodiment shown, the power lines 23, 24 are 240 volt lines, and thus each line is 120 volts above ground and is separately fused. The fuses off the right-hand power line 24 are wired directly to terminals **11*a*–15*a* of the heating elements. The fuses off the left-hand power line 23 are wired to normally-open relay contacts which are series-connected to the other terminals 11*b*–15*b* of the heating element. Two relays 56 are used, each having three independent pairs of contacts so that each heating element is series connected to an individual contact. The relays 56 shown in FIG. 1 are three pole "contactors" rated at 30 amps per pole (48 amps resistive load) (Sylvania Part No. A77-309044A-2 having a 240 V coil). The coils of the contactors 56 are wired in parallel and then series connected between a right and left-hand side fuse with the pressure-sensing switch 51, the thermostat switch 45, and the high-temperature sensitive switch 52 being wired in series with the contactor coils. Thus the contactors 56 are active to connect the heating elements 40 to the power lines 23, 24 only when the pressure switch 51 is closed indicating that the consumer is drawing water, the thermostat switch is closed indicating that the water in the last heating chamber 15 is colder than desired, and the high-temperature switch 52** is closed indicating the absence of an abnormal high temperature condition.

The embodiment shown in FIG. 1 uses conventional electro-mechanical controls. Although solid-state controls could be substituted to provide more even temperature regulation, the rather high total current of 125 amperes and the relatively high voltage of 240 volts suggest that the contactors 56 are more economical than triacs for controlling the connection of the heating elements to the electrical power source. The mechanical design of the water heating chambers 11–15 interconnected by the mixing coils 31–33 ensures that the hot water temperature is relatively constant despite the fact that the mechanical control system repetitively switches the heating elements on and off rather than continuously regulating the flow of power to the heating elements 40, as could be done with solid-state controls.

Figure 4:
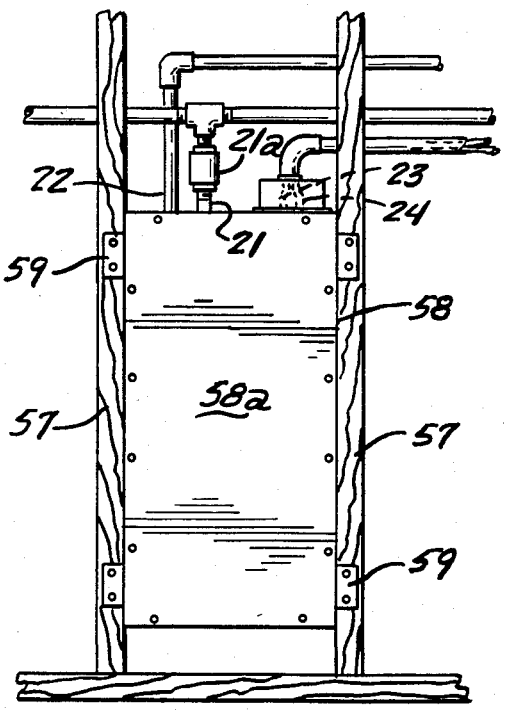
FIG. 4 is a front elevation view of the instantaneous water heater mounted inside a conventional wood wall between the studs, showing the utility connections.
Figure 5:
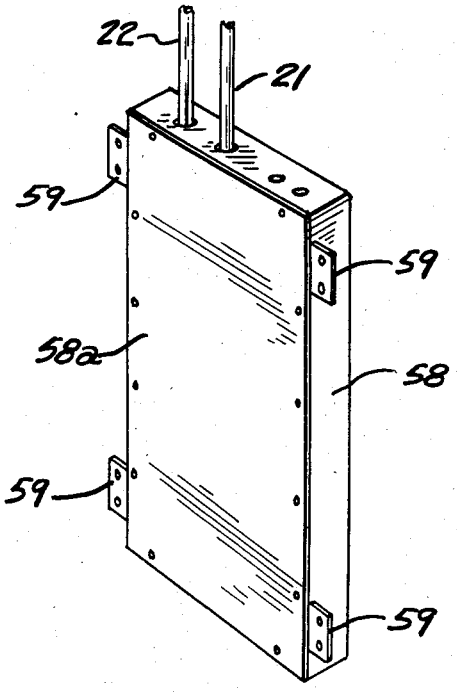
FIG. 5 is a perspective view of the instantaneous water heater before installation.

An important advantage of the instantaneous water heater according to the present invention is that it may be mounted between the studs 57 inside a conventional wood wall. As shown in FIGS. 4 and 5, the water heater components all fit inside a generally rectangular sheet metal enclosure 58 approximately 14½ inches wide and 4 inches deep. Preferably the sheet metal case has generally planar mounting brackets 59 to allow either external or internal wall mounting for both commercial and domestic environments. The sheet metal cover **58*a* provides user access for adjustment and maintenance. To limit the temperature rise of the encosure 58 when water is being heated, the heating chambers 11–15 and mixing coils 31–33 are encased in polyurethane foam insulation (not shown) filling the bottom half of the enclosure 58**.

Figure 6:
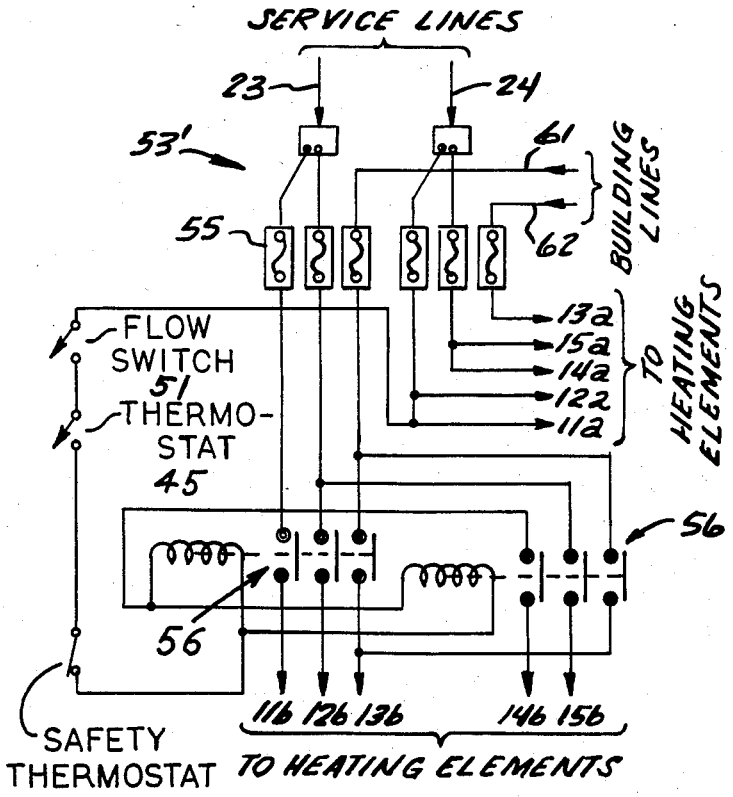
FIG. 6 is an alternative wiring schematic for connecting the instantaneous water heater to both the service lines and building lines of the electrical utility system thereby providing dual sourcing.

Another important feature of the present invention is that the electrical circuits 53 may be wired to accommodate a number of electrical source configurations. As shown in FIG. 6, the electrical circuits 53' are wired in an alternative configuration for dual sourcing wherein one source is the service lines 23, 24 and the second source is the building lines 61, 62. The service lines are conventionally the lines just after the electric power meter while the building lines are the lines just after the main fuse and terminal block inside the building. Local electric codes sometimes specify and restrict the maximum amperage per pair of independent lines. The instantaneous water heater, however, may be wired by the electrician familiar with the local codes to accommodate the minimum number of independent lines required to supply the power to the heating elements 40. The fuses 55 and contactors 56 accept up to three pairs of independent lines and hence they may be wired by an electrician in a fashion that will satisfy practically any local electric code. The wiring in FIG. 6, for example, connects the building lines 61, 62 to the heating element terminals 13*a* and 13*b* independent of the service lines 23, 24. It will become apparent to persons skilled in the electrical arts that if a sixth heating chamber is added, the six independent fuses and six independent pairs of relay contacts facilitates the wiring of the instantaneous water heater to three-phase industrial power lines by pairing the fuses, pairs of relay contacts, and heating elements and associating each pair with a respective one of the electrical phases.

Figure 7:
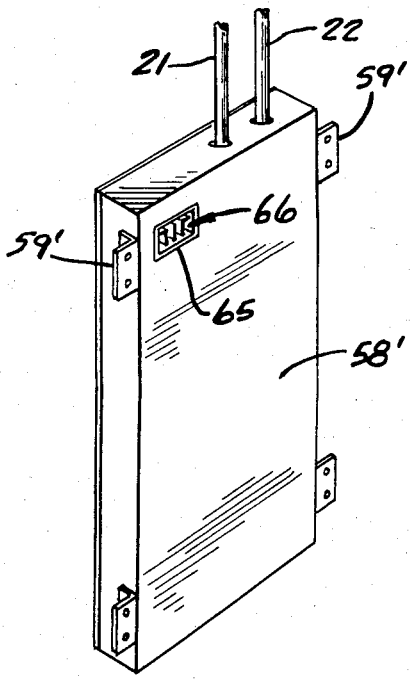
FIG. 7 is a back-side perspective view of an alternative design for the sheet metal case of the instantaneous water heater to permit wall mounting and a plug-in electrical connection.

Another alternative for connecting the instantaneous water heater to the electrical utility system is shown in FIG. 7. Brackets 59' are spot-welded at the back of the case 58' for wall mounting of the unit. An aperture 65 is provided in the back of the case 58' and is aligned with the electrical section 53 so that a male electrical connector 66 may plug into a female connector installed in the wall (not shown). This method of wall mounting facilitates installation and makes the instantaneous water heater a portable applicance, to be installed by the user at his option and convenience.

As can be seen from the foregoing detailed description, the present invention provides an instantaneous-type water heater which is an enery saving improvement over the conventional tank-type water heater without subjecting the consumer to an unduely limited flow of hot water. The instantaneous water heater provides a virtually endless supply of hot water at a precisely controlled temperature. The electrical heating elements are on only when the consumer desires hot water. The instantaneous water heater is space saving since it may be built into the conventional wall of a house. The small size does not limit the flow capacity or power dissipation, and in fact, thirty-thousand watts of heat are available when the consumer turns on his hot water tap. The instantaneous water heater also has means for regulating against excessive hot water demand and has a high-temperature switch for guarding against thermostat malfunction.

I claim:

1. An instantaneous-type water heating apparatus comprising, in combination, a cold water input pipe, a hot water output pipe, a plurality of water heating chambers connected in series flow relationship between the cold water input pipe and the hot water output pipe, said heating chambers having electrical heating elements for heating the water flowing through the chambers, means in series flow relationship between each adjacent pair of water heating chambers for mixing the water and temporarily storing and exchanging heat as the water flows from one chamber to the next in the series of chambers so that the water tends to be evenly heated, means responsive to the flow of water from the cold water input pipe through the heating chambers to the hot water output pipe for activating a flow switch in response to the flow exceeding a predetermined threshold, means responsive to the temperature of the water flowing out the hot water output pipe for activating a thermostat switch in response to the temperature exceeding a preset adjustable threshold temperature, and means for connecting the heating elements to a source of electrical power in reponse to the flow switch and the thermostat switch being simultaneously in their activated state, wherein the means for connecting the heating elements to a source of electrical power has at least two independent pairs of switch contacts and separate connections to both the building side and the service side of an electrical utility system supplying said source of electrical power, one pair of the switch contacts connecting at least one of the heating elements to the building side of the electrical utility system, and another pair connecting at least one other of the heating elements to the service side of the electrical utility system.

2. The combination as claimed in claim 1 wherein the combined power dissipation of the heating elements is at least thirty-thousand (30,000) watts.

3. The combination as claimed in claim 1, further comprising a generally rectangular sheet metal case enclosing said heating chambers, relay and switches, said case being approximately four inches deep and approximately fourteen and one-half inches wide and having planar mounting brackets for internal mounting inside a standard wood wall between the studs.

4. An instantaneous-type water heating apparatus comprising, in combination, a cold water input pipe, a hot water output pipe, a plurality of water heating chambers connected in series flow relationship between the cold water input pipe and the hot water output pipe, a metal mixing pipe in each series water path between each adjacent pair of water heating chambers, at least one being in the form of a rectangular coil to provide a temporary reservoir of water at room temperature, and to store and exchange heat to promote heating of the water to maintain a uniform temperature, a flow rate regulating device in series with the water path between the cold water input pipe and the hot water output pipe, so that the water flow rate will not exceed the capacity of the heating apparatus to raise the water temperature to a minimum acceptable level, an electrical heating element disposed within each water heating chamber, at least one relay having a relay coil and at least one pair of normally open contacts series-connecting the electrical heating elements to a source of electrical power, a thermostat switch having a variable temperature control and a temperature probe, the temperature probe operative to sense the temperature of water exiting the last heating chamber adjacent to the hot water output pipe in the water path, the thermostat switch being opened in response to the temperature sensed by the probe exceeding the temperature set by the variable temperature control, a high-temperature switch connected in series with the thermostat switch and responsive to temperatures in said last heating chamber and being opened by the presence of a temperature exceeding a fixed high temperature exceeding the temperature set by the variable temperature control, so that the high-temperature switch guards against malfunctions of the thermostat switch, and a water pressure-sensitive switch responsive to the difference in pressure between the cold water input pipe and the hot water output pipe, the pressure-sensitive switch being closed in response to the pressure difference exceeding a predetermined pressure threshold, the pressure-sensitive switch and the thermostat switch and the high-temperature sensitive switch all being in series with the relay coil and an electrical power source so that the heating elements are energized only in response to the pressure sensitive switch, the thermostat switch, and the high temperature switch simultaneously being in closed condition, wherein the number of operative pairs of independent relay contacts is at least two and further including separate connections to both the building side and the service side of an electrical utility system supplying said source of electrical power, one pair of relay contacts connecting at least one of the heating elements in series with the service side of the electrical utility system, and the other pair of relay contacts connecting at least one other of the heating elements to the building side of the electrical utility system.

5. The combination as claimed in claim 4, wherein the combined power dissipation of the heating elements is at least thirty-thousand (30,000) watts.

6. The combination as claimed in claim 4, further comprising a generally rectangular sheet metal case enclosing said heating chambers, relay and switches, said case being approximately four inches deep and approximately fourteen and one-half inches wide and having planar mounting brackets for internal mounting inside a standard wood wall between the studs.

7. A method of installing an instantaneous-type water heater in a building serviced by an electrical utility system having electrical service lines and electrical building lines, the instantaneous water heater having a cold water input pipe, a hot water output pipe, a number of electrical heating elements, means for directing a flow of water from the cold water input pipe to the hot water output pipe so that the flow of water receives heat from said electrical heating elements, means responsive to the flow of water from the cold water input pipe to the hot water output pipe for activating a flow switch in response to the flow exceeding a predetermined threshold, means responsive to the temperature of the water flowing out the hot water output pipe for activating a thermostat switch in response to the temperature exceeding a preset adjustable threshold temperature, and means for connecting the heating elements to a source of electrical power in response to the flow switch and thermostat switch being simultaneously in their activated state, said means for connecting the heating elements to a source of electrical power including at least two independent pairs of switch contacts, a first one of said pairs for connecting at least a first one of the heating elements and a second one of said pairs for connecting at least a second one of said heating elements, the combined power dissipation of the heating elements being at least thirty-thousand (30,000) watts, said method of installing the instantaneous water heater comprising the steps of connecting said first pair of switch contacts and said first heating element to said building lines on the building side of said electrical utility system, and connecting said second pair of switch contacts and said second heating element to said service lines on the service side of said electrical utility system, so that said combined power dissipation of the heating elements may exceed the maximum power rating of said building lines.

* * * * *